US011335987B2

(12) United States Patent
Tokuda

(10) Patent No.: US 11,335,987 B2
(45) Date of Patent: May 17, 2022

(54) DIRECTIONAL COUPLER

(71) Applicant: Murata Manufacturing Co., Ltd., Kyoto (JP)

(72) Inventor: Daisuke Tokuda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/032,665

(22) Filed: Sep. 25, 2020

(65) Prior Publication Data

US 2021/0013579 A1 Jan. 14, 2021

Related U.S. Application Data

(63) Continuation of application No. PCT/JP2019/012951, filed on Mar. 26, 2019.

(30) Foreign Application Priority Data

Mar. 29, 2018 (JP) ..... JP2018-064532

(51) Int. Cl.
*H01P 5/18* (2006.01)

(52) U.S. Cl.
CPC ..... *H01P 5/184* (2013.01)

(58) Field of Classification Search
CPC ..... H01P 5/18
See application file for complete search history.

(56) References Cited

U.S. PATENT DOCUMENTS 5,363,071 A 11/1994 Schwent et al.
6,542,375 B1 4/2003 Kuitenbrouwer et al.
7,009,467 B2 * 3/2006 Sawicki ..... H01P 5/185 333/116
8,330,552 B2 * 12/2012 Li ..... H01P 5/187 333/116
9,356,330 B1 * 5/2016 Donoghue ..... H01P 5/187
10,498,004 B1 12/2019 Ji et al.
(Continued)

FOREIGN PATENT DOCUMENTS

JP S61-184901 A 8/1986
JP H08-116203 A 5/1996
(Continued)

OTHER PUBLICATIONS

International Search Report for International Application No. PCT/JP2019/012951 dated Jun. 11, 2019.
(Continued)

*Primary Examiner* — Dean O Takaoka
(74) *Attorney, Agent, or Firm* — Pearne & Gordon LLP

(57) ABSTRACT

A directional coupler (1) includes a surface mounted component (10) and a mounting substrate (20) on which the surface mounted component (10) is mounted. Among a main line and a sub line of the directional coupler (1), the main line is formed of a first line (31) and a second line (32), one end (311) of the first line (31) and one end (321) of the second line (32) being connected to each other, the sub line is formed of a third line (33). The first line (31) and the third line (33) are formed in the surface mounted component (10). The second line (32) is formed on or in the mounting substrate (20). Furthermore, another end (312) of the first line (31) and another end (322) of the second line (32) may be connected to each other.

16 Claims, 5 Drawing Sheets

(56) References Cited

U.S. PATENT DOCUMENTS

| | | | | |
|---|---|---|---|---|
| 2008/0070519 | A1* | 3/2008 | Okabe | H01P 5/184 455/127.1 |
| 2011/0001575 | A1 | 1/2011 | Laporte et al. | |
| 2011/0316646 | A1 | 12/2011 | Li et al. | |
| 2013/0141184 | A1 | 6/2013 | Tamaru et al. | |
| 2016/0268668 | A1 | 9/2016 | Mitake | |
| 2016/0268994 | A1* | 9/2016 | Granger-Jones | H01F 38/14 |
| 2018/0062236 | A1 | 3/2018 | Okamoto | |

FOREIGN PATENT DOCUMENTS

| | | | |
|---|---|---|---|
| JP | H08-307116 | A | 11/1996 |
| JP | 2861228 | B2 | 2/1999 |
| JP | 2011-019215 | A | 1/2011 |
| JP | 2013-102367 | A | 5/2013 |
| JP | 2016-171398 | A | 9/2016 |
| WO | 2011/163333 | A2 | 12/2011 |
| WO | 2012/017713 | A1 | 2/2012 |
| WO | 2017/013927 | A1 | 1/2017 |

OTHER PUBLICATIONS

Written Opinion for International Application No. PCT/JP2019/012951 dated Jun. 11, 2019.
Office Action for CN Patent Application No. 201980021110.7 dated Apr. 26, 2021.

* cited by examiner

DIRECTIONAL COUPLER

This is a continuation of International Application No. PCT/JP2019/012951 filed on Mar. 26, 2019 which claims priority from Japanese Patent Application No. 2018-064532 filed on Mar. 29, 2018. The contents of these applications are incorporated herein by reference in their entireties.

BACKGROUND OF THE DISCLOSURE

Field of the Disclosure

The present disclosure relates to a directional coupler.

Description of the Related Art

In the related art, there is a directional coupler that includes a main line and a sub line inside a multilayer body (for example, refer to Patent Document 1). The directional coupler is mounted on a mounting substrate for use.

Patent Document 1: International Publication No. 2012/017713

BRIEF SUMMARY OF THE DISCLOSURE

However, with this directional coupler, it is difficult to adjust the degree of coupling between the main line and the sub line when it becomes necessary to adjust the degree of coupling after the formation of a multilayer surface mounted component.

Accordingly, an object of the present disclosure is to provide a directional coupler in which the degree of coupling can be easily adjusted even after a surface mounted component has been formed.

In order to realize this object, a directional coupler according to one aspect of the present disclosure includes a surface mounted component and a mounting substrate on which the surface mounted component is mounted. Among a main line and a sub line of the directional coupler, one line is formed of a first line and a second line, one end of the first line and one end of the second line being connected to each other, the other line is formed of a third line, the first line and the third line are formed in the surface mounted component, and the second line is formed on or in the mounting substrate.

The degree of coupling of a directional coupler formed of a surface mounted component may vary due to various factors after the formation of the surface mounted component. For example, the degree of coupling varies when the surface mounted component is mounted on a mounting substrate. In order to compensate for variations in the degree of coupling, it is necessary to adjust the degree of coupling for each factor (for example, for each mounting substrate), but unlike characteristics such as directivity and isolation, it is difficult to electrically adjust the degree of coupling using a variable impedance circuit or the like. A great deal of time and money would be required to redesign and re-manufacture the surface mounted component to obtain the required degree of coupling. Thus, in a directional coupler formed of a surface mounted component, it is difficult to adjust the degree of coupling after the formation of the surface mounted component.

In contrast, with the directional coupler according to the present invention, the degree of coupling of the directional coupler is determined by the degree of coupling generated in the surface mounted component between the first line and the third line and the degree of coupling between the surface mounted component and the mounting substrate, which is between the second line and the third line. Therefore, the degree of coupling generated in the surface mounted component can be regarded as the principle degree of coupling of the directional coupler and the degree of coupling of the directional coupler can be adjusted using the degree of coupling between the surface mounted component and the mounting substrate.

Thus, with the directional coupler according to the present invention, a directional coupler is obtained in which the degree of coupling can be easily adjusted even after the formation of the surface mounted component.

DETAILED DESCRIPTION OF THE DISCLOSURE

A plurality of embodiments of the present disclosure will be described in detail using the drawings. The embodiments described hereafter each illustrate a comprehensive or specific example of the present invention. The numerical values, shapes, materials, constituent elements, arrangement of the constituent elements, the ways in which the constituent elements are connected to each other and so forth given in the following embodiments are merely examples and are not intended to limit the present invention.

Embodiment 1

A directional coupler according to embodiment 1 will be described using an example of a directional coupler that includes a surface mounted component and a mounting substrate on which the surface mounted component is mounted. A main line of the directional coupler consists of two lines, one of which is formed on or in the surface mounted component and the other of which is formed on or in the mounting substrate and the ends of the two lines are connected to each other.

Figure 1:
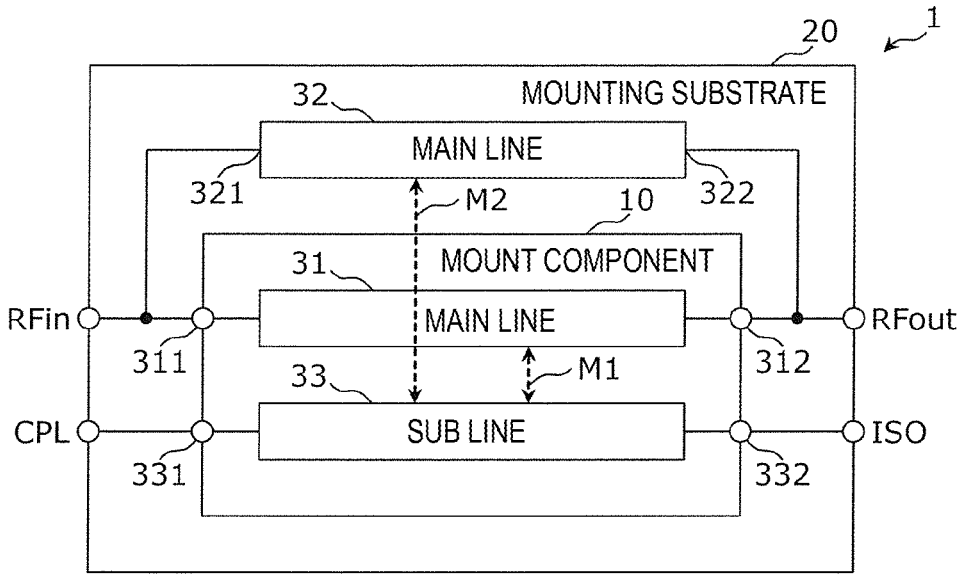
FIG. 1 is a circuit diagram illustrating an example of the functional configuration of a directional coupler according to embodiment 1.

FIG. 1 is a circuit diagram illustrating an example of the functional configuration of the directional coupler according to embodiment 1.

As illustrated in FIG. 1, a directional coupler 1 includes a surface mounted component 10 and a mounting substrate 20 on which the surface mounted component 10 is mounted.

Among a main line and a sub line of the directional coupler 1, the main line consists of a line 31 and a line 32 and the sub line consists of a line 33. One end 311 of the line 31 and one end 321 of the line 32 are connected to each other and another end 312 of the line 31 and another end 322 of the line 32 are connected to each other. The line 31 and the line 33 are formed in the surface mounted component 10 and the line 32 is formed on or in the mounting substrate 20. Here, the lines 31, 32, and 33 are examples of a first line, a second line, and a third line, respectively.

A connection point between the one end 311 of the line 31 and the one end 321 of the line 32 is one end of the main line and is connected to an input port RFin, and a connection point between the other end 312 of the line 31 and the other end 322 of the line 32 is the other end of the main line and is connected to an output port RFout. One end 331 of the line 33 is one end of the sub line and is connected to a coupling port CPL, and another end 332 of the line 33 is the other end of the sub line and is connected to an isolation port ISO. Alternatively, the one end 331 of the sub line may be connected to the isolation port ISO, and the other end 332 of the sub line may be connected to the coupling port CPL.

The degree of coupling of the directional coupler 1 is determined by a degree of coupling M1 generated in the surface mounted component 10 between the line 31 and the line 33 and a degree of coupling M2 between the surface mounted component 10 and the mounting substrate 20, which is between the line 32 and the line 33. Therefore, the degree of coupling M1 generated in the surface mounted component 10 can be regarded as the principle degree of coupling of the directional coupler 1, and the degree of coupling of the directional coupler 1 can be adjusted using the degree of coupling M2 between the surface mounted component 10 and the mounting substrate 20.

Figure 2:
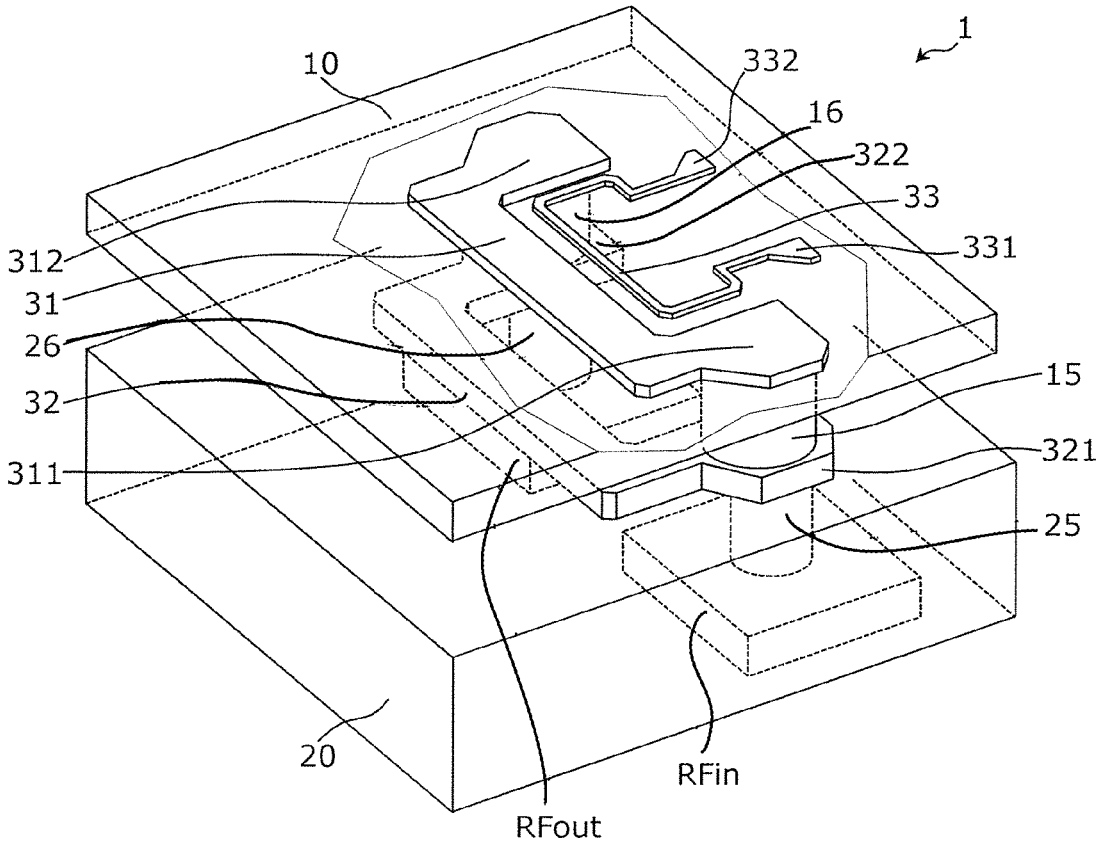
FIG. 2 is a partial cutaway perspective view illustrating an example of the structure of the directional coupler according to embodiment 1.

FIG. 2 is a partial cutaway perspective view illustrating an example of the structure of the directional coupler 1.

In the example in FIG. 2, the surface mounted component 10 is a semiconductor integrated circuit device having a multilayer structure, and the lines 31 and 33 are for example thin metal films formed inside the surface mounted component 10 using a semiconductor process. In addition, the mounting substrate 20 is a wiring substrate in which wiring conductors are arranged on substrate layers formed of a ceramic or resin material. The line 32 is a thick metal film that is formed inside the mounting substrate 20 or on the mounting substrate 20 using a printing process or an etching process, for example.

The one end 311 and the other end 312 of the line 31 are connected to surface electrodes (not illustrated) on the surface mounted component 10 and are also connected to the one end 321 and the other end 322 of the line 32 of the mounting substrate 20 via electrically conductive bonding materials 15 and 16 such as solder.

The one end 321 and the other end 322 of the line 32 are respectively connected to the input port RFin and the output port RFout on the mounting substrate 20 by via conductors 25 and 26 inside the mounting substrate 20.

For example, the one end 331 and the other end 332 of the line 33 may be connected to a circuit (not illustrated) such as a variable terminator circuit inside the surface mounted component 10 and may be connected to a coupling port CPL and an isolation port ISO (not illustrated) on the mounting substrate 20 using electrically conductive bonding materials and via conductors.

The main line described in this specification is a line that electromagnetically couples with the sub line with a prescribed degree of coupling, this prescribed degree of coupling being a degree of coupling that determines the degree of coupling of the directional coupler. In other words, among lines that electromagnetically couple with the sub line, the main line is a line whose degree of coupling with the sub line is a prescribed degree of coupling that determines the degree of coupling of the directional coupler.

For example, in the directional coupler 1 according to embodiment 1, the line 31 and the line 32 electromagnetically couple with the line 33, and the degree of coupling of the directional coupler 1 is determined by the degree of coupling M1 between the line 31 and the line 33 and the degree of coupling M2 between the line 32 and the line 33. Therefore, in the case where the line 33 forms the sub line of the directional coupler 1, the line 31 and the line 32 form the main line of the directional coupler 1. On the other hand, the electrically conductive bonding materials 15 and 16 connecting the line 31 and the line 32 to each other and the via conductors 25 and 26 connecting the line 32 and the input port RFin and the output port RFout to each other also slightly electromagnetically couple with the line 33, which is the sub line of the directional coupler 1.

However, the degree of coupling between the electrically conductive bonding materials 15 and 16 and the line 33 and the degree of coupling between the via conductors 25 and 26 and the line 33 are not degrees of coupling that determine the degree of coupling of the directional coupler 1. Therefore, the electrically conductive bonding materials 15 and 16 and the via conductors 25 and 26 are not lines that form the main line.

Next, the characteristics of the directional coupler 1 will be described. In the following description, the directional coupler 1 of embodiment 1 is taken as an example and a directional coupler consisting of only the surface mounted component 10 included in the directional coupler 1 is taken as a comparative example, and the characteristics of the example and the comparative example are compared and contrasted.

Figure 3:
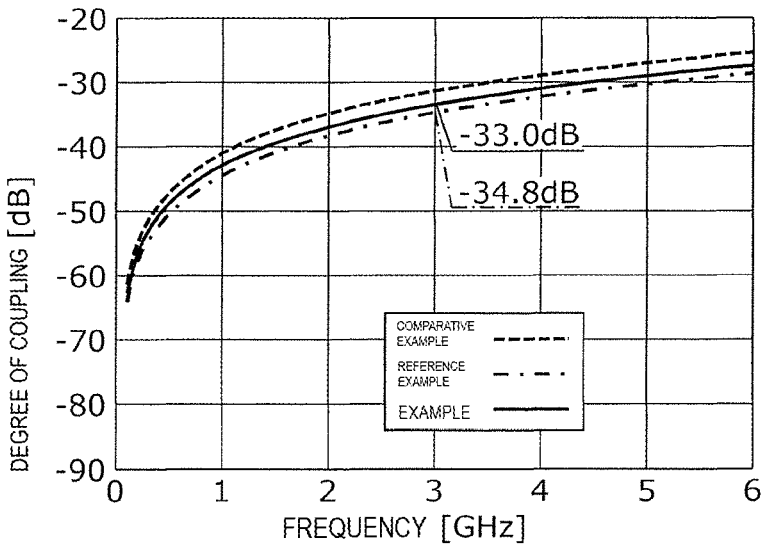
FIG. 3 is a graph illustrating an example of the degree of coupling and isolation of directional couplers according to an example and a comparative example.

FIG. 3 is a graph illustrating an example of the degrees of coupling of the directional couplers according to the example, the comparative example, and a reference example. The reference example is the degree of coupling in a directional coupler in which the surface mounted component 10 is mounted on a mounting substrate that does not have a line for adjusting the degree of coupling. Here, "a line for adjusting the degree of coupling" is a line that is connected to one of the main line and the sub line inside the surface mounted component 10 and that together with the main line or the sub line inside the surface mounted component 10 form the main line or the sub line of the directional coupler, and in the example of FIGS. 1 and 2, the line 32 corresponds to this line for adjusting the degree of coupling.

The degree of coupling of the comparative example illustrated in FIG. 3 is the original degree of coupling possessed by the directional coupler formed of just the surface mounted component 10. The degree of coupling of the comparative example corresponds to the degree of coupling M1 illustrated in FIG. 1. The degree of coupling M1 is a degree of coupling between the line 31 and the line 33 formed in the surface mounted component 10.

In general, compared with lines formed on or in a mounting substrate, lines formed in a surface mounted component tend to have smaller film thicknesses and smaller line widths because thin-film microfabrication techniques can be used. Therefore, compared with a directional coupler formed using lines formed on or in a mounting substrate, a directional coupler formed using lines formed in a surface mounted component can be reduced in size, has fewer variations in the degree of coupling due to manufacturing variations, and is more stable.

The degree of coupling M1 in the surface mounted component 10 may vary due to various factors after the formation of the surface mounted component 10. Factors responsible for variations in the degree of coupling M1 are not particularly limited, but one example is the degree of coupling M1 being reduced as a result of the surface mounted component 10 being mounted on a mounting substrate. This may be due to an increase in parasitic reactance components at the coupling port and the isolation port. As illustrated in FIG. 3, the degree of coupling in the reference example in which the surface mounted component 10 is mounted on a mounting substrate that does not have a line for adjusting the degree of coupling is smaller than the degree of coupling in the comparative example.

In order to compensate for variations in the degree of coupling, it is necessary to adjust the degree of coupling for each factor (for example, for each mounting substrate), but unlike characteristics such as directivity and isolation, it is difficult to electrically adjust the degree of coupling using a variable impedance circuit or the like. A great deal of time and money would be required to redesign and re-manufacture the surface mounted component 10 to obtain the required degree of coupling.

Accordingly, in the directional coupler 1 of the example, the surface mounted component 10 is mounted on the mounting substrate 20 that has a line for adjusting the degree of coupling. In this way, the degree of coupling in the example is adjusted using the adjustment degree of coupling provided by the line for adjusting the degree of coupling between the surface mounted component 10 and the mounting substrate 20 and for example the degree of coupling is increased from the degree of coupling in the reference example. For example, if the required degree of coupling at 3 GHz is 33 dB, the degree of coupling in the example increases to −33.0 dB, where the coupling degree in the reference example is −34.8 dB, and the required value is obtained.

"The adjustment degree of coupling" corresponds to the degree of coupling M2 illustrated in FIG. 1. The degree of coupling M2 is the degree of coupling between the line 32 and the line 33 and therefore the degree of coupling M2 can be easily changed by changing the arrangement of the surface mounted component 10 on the mounting substrate 20.

Furthermore, the degree of coupling between the line 32 and the line 33 can also be changed by changing the arrangement of the line 32 on or in the mounting substrate 20. In this case, the mounting substrate 20 is redesigned and manufactured, but for example when the surface mounted component 10 is a semiconductor integrated device and the mounting substrate 20 is a wiring substrate composed of a ceramic or resin material, the mounting substrate 20 can be redesigned and manufactured in a significantly shorter time and at a significantly lower cost than the surface mounted component 10.

In other words, the adjustment degree of coupling M2 can be changed more easily than changing the degree of coupling M1 in the surface mounted component 10.

In this way, as illustrated in FIG. 3, the reduced degree of coupling in the reference example is adjusted to realize the required value in the example.

Figure 4:
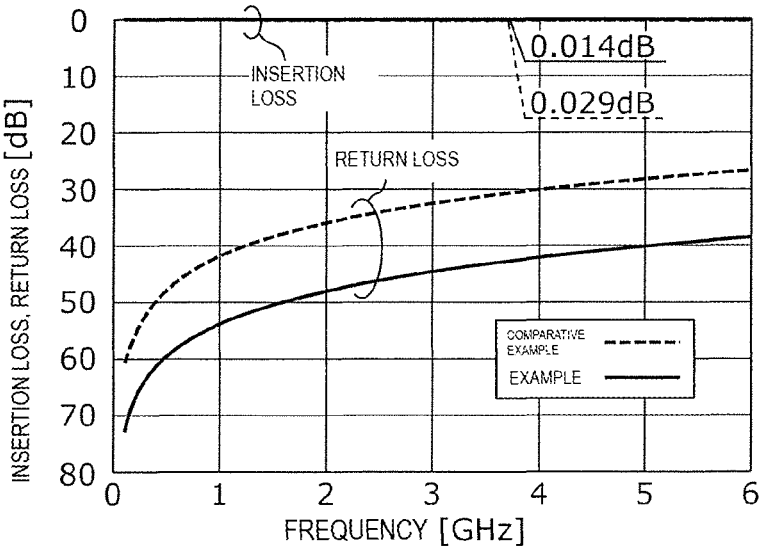
FIG. 4 is a graph illustrating an example of the insertion loss and return loss of the directional couplers according to the example and the comparative example.

FIG. 4 is a graph illustrating an example of the insertion loss and return loss of the directional couplers according to the example and the comparative example. From FIG. 4, it is clear that the insertion loss and return loss are reduced in the example compared with the comparative example. For example, the insertion loss at 3.7 GHz is reduced to 0.014 dB in the example compared to 0.029 dB in the comparative example. The return loss is also significantly reduced in the example compared with the comparative example.

The improved insertion loss in the example is due to the main line of the directional coupler 1 consisting of the line 31 and the line 32 connected to each other at both ends. In general, the line 32 formed on or in the mounting substrate 20 will tend to have a larger film thickness and a larger wiring width than the line 31 formed in the surface mounted component 10. In addition, signal loss becomes smaller as the film thickness and width of a line through which a signal flows increase. Therefore, the insertion loss of the main line can be reduced by forming the main line not only in the surface mounted component 10 but also on or in the mounting substrate 20.

In addition, the improved return loss in the example is also due to the main line of the directional coupler 1 being formed of a plurality of lines, i.e., the line 31 and the line 32 connected to each other at both ends. This reduces the impedance of the main line and therefore it is easier to bring the impedance closer to a reference impedance for matching such as 50Ω and thus return loss is reduced.

Thus, according to the directional coupler 1, a directional coupler is obtained in which the degree of coupling can be easily adjusted even after the formation of the surface mounted component 10 while improving various characteristics (particularly insertion loss) of a directional coupler consisting only of the surface mounted component 10.

Details and modifications of the directional coupler 1 will be described hereafter.

Figure 5:
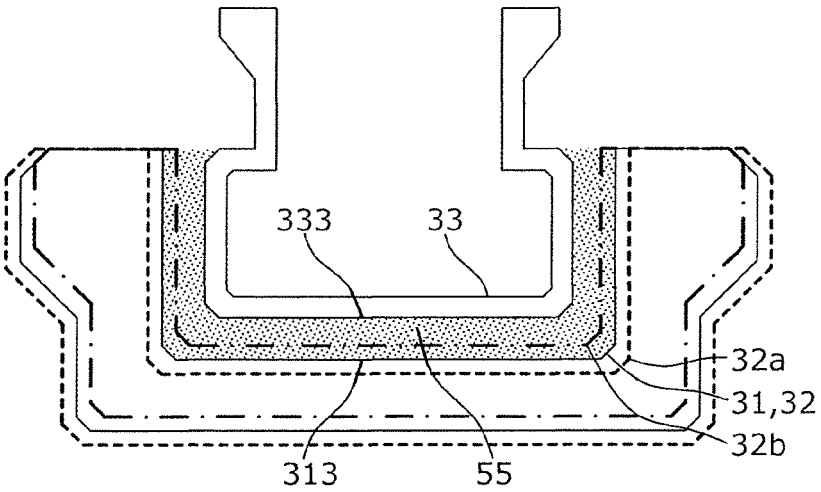
FIG. 5 is a plan view illustrating an example of the arrangement of lines of the directional coupler according to embodiment 1.

FIG. 5 is a plan view illustrating an example of the arrangement of the line 31, the line 32, and the line 33 in the directional coupler 1. FIG. 5 illustrates an example of the planar arrangement of the line 31, the line 32, and the line 33 in a plan view of the mounting substrate 20.

In a plan view of the mounting substrate 20, the line 32 may be arranged in a region that is identical to the arrangement region of the line 31 or may be arranged in a region that is shifted from the arrangement region of the line 31. For example, the line 32 may be arranged in a region obtained by shifting the arrangement region of the line 31 in a direction so as to not overlap a region 55 interposed between the line 31 and the line 33 as indicated by a line 32*a* or may be arranged in a region obtained by shifting the arrangement region of the line 31 in a direction so as to overlap the region 55 as indicated by a line 32*b*. Furthermore, not limited to this example, the line 32 may be arranged in a region obtained by shifting part of the arrangement region of the line 31 in a direction so as not to overlap the region 55 and shifting the remaining part in a direction so as to overlap the region 55 (not illustrated).

Here, the region 55 interposed between the line 31 and the line 33 is a gap region located between the opposing sides 313 and 333 of the line 31 and the line 33. In FIG. 5, the region 55 is shaded gray and the lines 32*a* and 32*b* are respectively illustrated using the dashed lines and the dot and dash lines.

A configuration in which the line 32 is arranged in the same region as the line 31, i.e., a configuration in which the line 32 and the line 31 completely overlap in a plan view, as is the case for the lines 31 and 32 illustrated using the solid lines in FIG. 5, is effective for stabilizing the degree of coupling between the main line and the sub line of the directional coupler 1.

In a configuration in which the line 32 is arranged so as to be shifted from the line 31 in a direction so as to not overlap the region 55 as indicated by the line 32*a* for example, the adjustment degree of coupling between the line 32 and the line 33 becomes smaller, and therefore the degree of coupling of the directional coupler 1 can be adjusted so as to realize looser coupling compared with a configuration in which the line 32 and the line 31 are arranged in the same region.

In a configuration in which the line 32 is arranged so as to be shifted from the line 31 in a direction so as to overlap the region 55 as indicated by the line 32*b* for example, the adjustment degree of coupling between the line 32 and the line 33 becomes larger, and therefore the degree of coupling of the directional coupler 1 can be adjusted so as to realize tighter coupling compared with the configuration in which the line 32 and the line 31 are arranged in the same region.

It is not necessary for the line 31 and the line 32 to be connected to each other at both ends in order to adjust the degree of coupling. The line 31 and the line 32 may be connected to each other at just one end.

Figure 6:
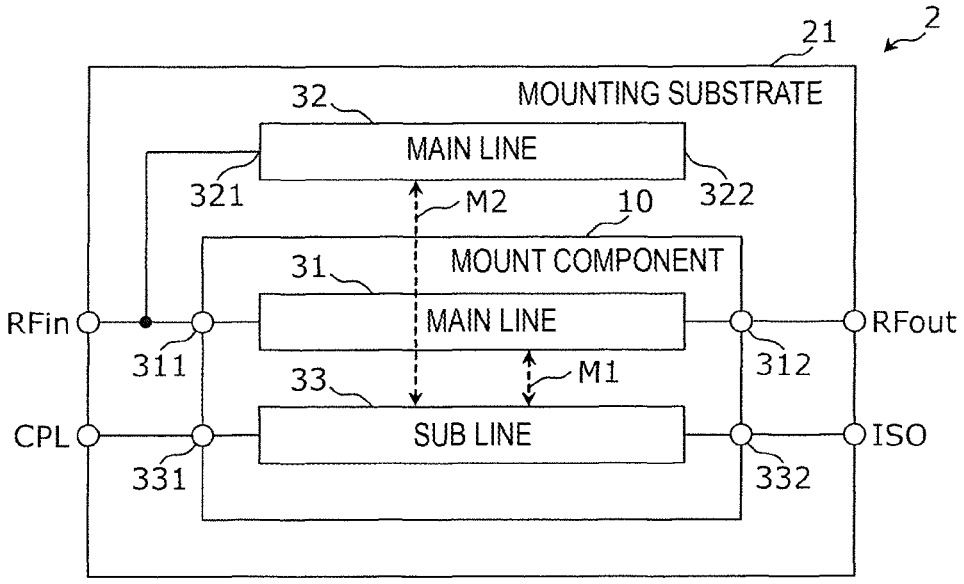
FIG. 6 is a circuit diagram illustrating an example of the functional configuration of a directional coupler according to a modification of embodiment 1.

FIG. 6 is a circuit diagram illustrating an example of the functional configuration of a directional coupler according to a modification. As illustrated in FIG. 6, compared with the directional coupler 1 in FIG. 1, in a directional coupler 2, the wiring conductor that connects the other end 312 of the line 31 and the other end 322 of the line 32 to each other is omitted from a mounting substrate 21. Therefore, in the directional coupler 2, the lines 31 and 32 are connected to each other only at the one ends 311 and 321.

In the directional coupler 2 as well, the line 31 and the line 32 are connected to each other at the one ends 311 and 321, and as a result, the overall degree of coupling of the directional coupler 2 can be adjusted using the degree of coupling M2 between the line 32 and the line 33.

Embodiment 2

A directional coupler according to embodiment 2 will be described using an example of a directional coupler that includes a surface mounted component and a mounting substrate on which the surface mounted component is mounted. A sub line of the directional coupler consists of two lines, one of which is formed on or in the surface mounted component and the other of which is formed on or in the mounting substrate and the ends of the two lines are connected to each other.

Figure 7:
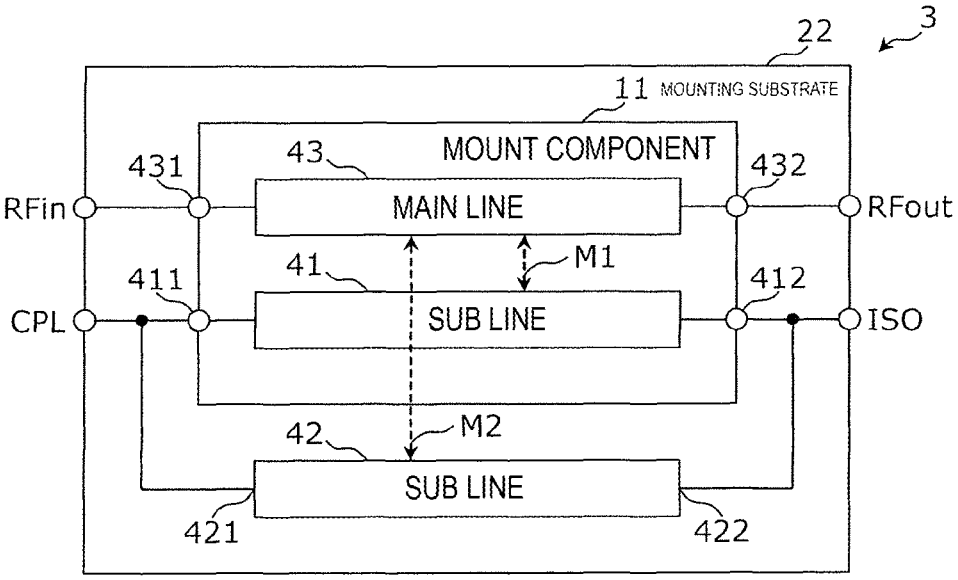
FIG. 7 is a circuit diagram illustrating an example of the functional configuration of a directional coupler according to embodiment 2.

FIG. 7 is a circuit diagram illustrating an example of the functional configuration of the directional coupler according to embodiment 2.

As illustrated in FIG. 7, a directional coupler 3 includes a surface mounted component 11 and a mounting substrate 22 on which the surface mounted component 11 is mounted.

Among a main line and a sub line of the directional coupler 3, the main line consists of a line 43 and the sub line consists of a line 41 and a line 42. One end 411 of the line 41 and one end 421 of the line 42 are connected to each other, and another end 412 of the line 41 and another end 422 of the line 42 are connected to each other. The line 41 and the line 43 are formed in the surface mounted component 11, and the line 42 is formed on or in the mounting substrate 22. Here, the lines 41, 42, and 43 are examples of a first line, a second line, and a third line, respectively.

One end 431 of the line 43 is one end of the main line and is connected to an input port RFin, and another end 432 of the line 43 is the other end of the main line and is connected to an output port RFout. A connection point between the one end 411 of the line 41 and the one end 421 of the line 42 is one end of the sub line and is connected to a coupling port CPL, and a connection point between the other end 412 of the line 41 and the other end 422 of the line 42 is the other end of the sub line and is connected to an isolation port ISO. Alternatively, the connection point between the one end 411 of the line 41 and the one end 421 of the line 42, which is the one end of the sub line, may be connected to the isolation port ISO, and the connection point between the other end 412 of the line 41 and the other end 422 of the line 42, which is the other end of the sub line, may be connected to the coupling port CPL.

The degree of coupling of the directional coupler 3 is determined by a degree of coupling M1 generated in the surface mounted component 11 between the line 41 and the line 43 and a degree of coupling M2 between the surface mounted component 11 and the mounting substrate 22, which is between the line 42 and the line 43. Therefore, the degree of coupling M1 generated in the surface mounted component 11 can be regarded as the principle degree of coupling of the directional coupler 3, and the degree of coupling of the directional coupler 3 can be adjusted using the degree of coupling M2 between the surface mounted component 11 and the mounting substrate 22.

Figure 8:
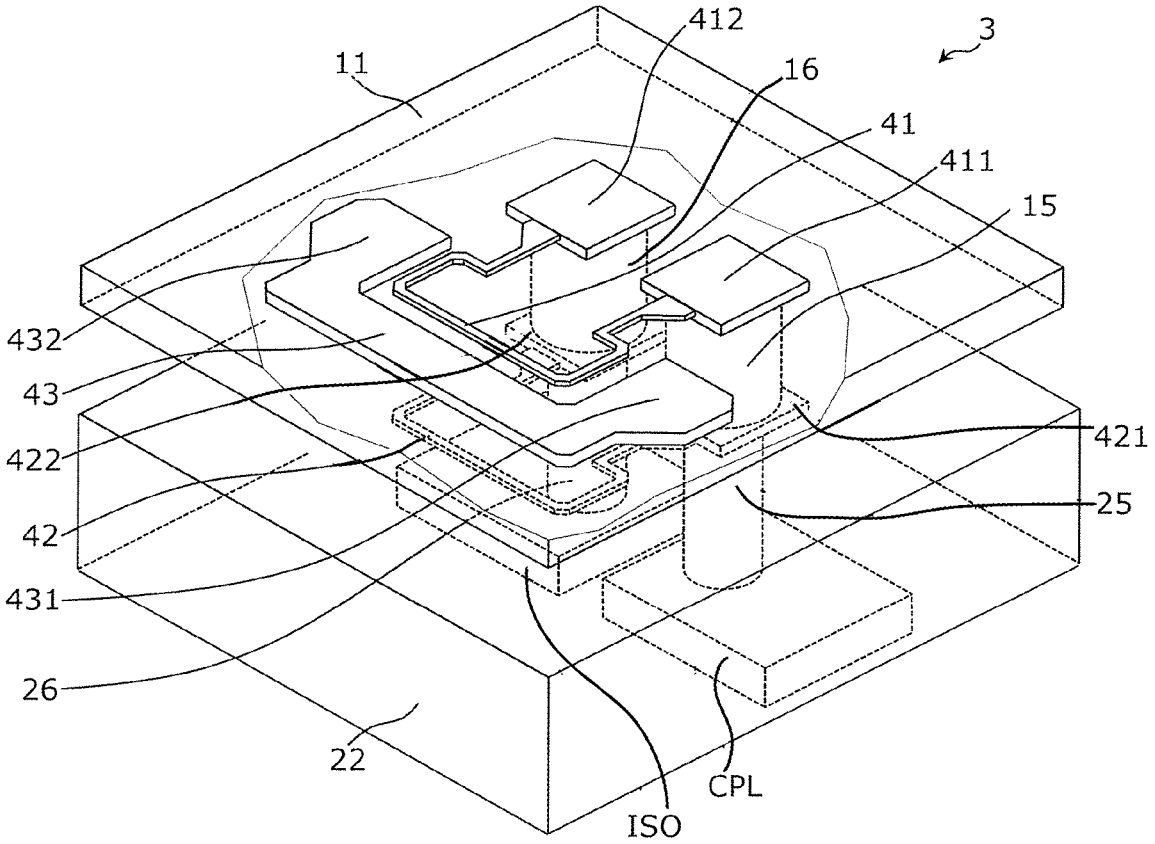
FIG. 8 is a partial cutaway perspective view illustrating an example of the structure of the directional coupler according to embodiment 2.

FIG. 8 is a partial cutaway perspective view illustrating an example of the structure of the directional coupler 3.

In the example in FIG. 8, the surface mounted component 11 is a semiconductor integrated circuit device having a multilayer structure and the lines 41 and 43 are for example thin metal films formed inside the surface mounted component 11 using a semiconductor process. In addition, the mounting substrate 22 is a wiring substrate in which wiring conductors are arranged on substrate layers formed of a ceramic or resin material. The line 42 is a thick metal film that is formed inside the mounting substrate 22 or on the mounting substrate 22 using a printing process or an etching process, for example.

The one end 411 and the other end 412 of the line 41 are connected to surface electrodes (not illustrated) on the surface mounted component 11 and are also connected to the one end 421 and the other end 422 of the line 42 of the mounting substrate 22 via electrically conductive bonding materials 15 and 16 such as solder.

The one end 421 and the other end 422 of the line 42 are respectively connected to the coupling port CPL and the isolation port ISO on the mounting substrate 20 by via conductors 25 and 26 inside the mounting substrate 22.

Similarly, the one end 431 and the other end 432 of the line 43 are also connected to the input port RFin (not illustrated) and the output port RFout (not illustrated) on the mounting substrate 22 using electrically conductive bonding materials and via conductors.

The sub line described in this specification is a line that electromagnetically couples to the main line with a prescribed degree of coupling, this prescribed degree of coupling being a degree of coupling that determines the degree of coupling of the directional coupler. In other words, among lines that electromagnetically couple with the main line, the sub line is a line whose degree of coupling with the main line is a prescribed degree of coupling that determines the degree of coupling of the directional coupler.

For example, in the directional coupler 3 according to embodiment 2, the line 41 and the line 42 electromagnetically couple with the line 43 and the degree of coupling of the directional coupler 3 is determined by the degree of coupling M1 between the line 41 and the line 43 and the degree of coupling M2 between the line 42 and the line 43. Therefore, in the case where the line 43 forms the main line of the directional coupler 3, the line 41 and the line 42 form the sub line of the directional coupler 3.

On the other hand, the electrically conductive bonding materials 15 and 16 connecting the line 41 and the line 42 to each other and the via conductors 25 and 26 connecting the line 42 and the coupling port CPL and the isolation port ISO to each other also slightly electromagnetically couple with the line 43, which is the main line of the directional coupler 3.

However, the degree of coupling between the electrically conductive bonding materials 15 and 16 and the line 43 and the degree of coupling between the via conductors 25 and 26 and the line 43 are not degrees of coupling that determine the degree of coupling of the directional coupler 3. Therefore, the electrically conductive bonding materials 15 and 16 and the via conductors 25 and 26 are not lines that form the sub line.

Details and modifications of the directional coupler 3 will be described hereafter.

Figure 9:
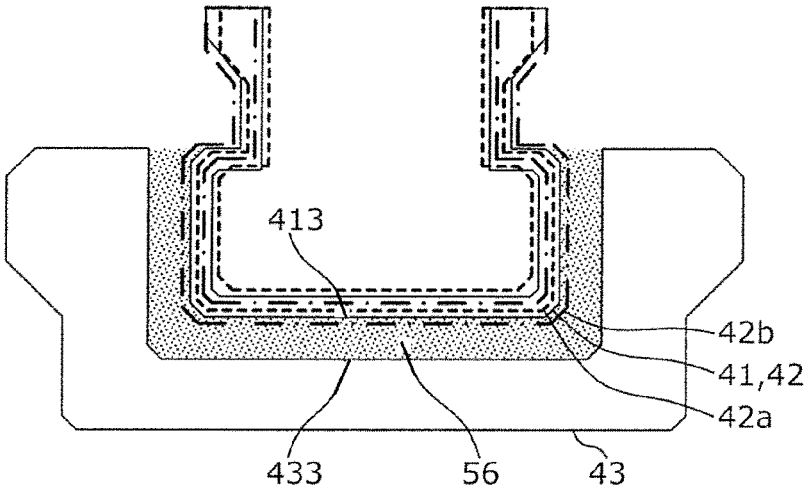
FIG. 9 is a plan view illustrating an example of the arrangement of lines of the directional coupler according to embodiment 2.

FIG. 9 is a plan view illustrating an example of the arrangement of the line 41, the line 42, and the line 43 in the directional coupler 3. FIG. 9 illustrates an example of the planar arrangement of the line 41, the line 42, and the line 43 in a plan view of the mounting substrate 22.

In a plan view of the mounting substrate 22, the line 42 may be arranged in a region that is identical to the arrangement region of the line 41 or may be arranged in a region that is shifted from the arrangement region of the line 41. For example, the line 42 may be arranged in a region obtained by shifting the arrangement region of the line 41 in a direction so as to not overlap a region 56 interposed between the line 41 and the line 43 as indicated by a line 42*a* or may be arranged in a region obtained by shifting the arrangement region of the line 41 in a direction so as to overlap the region 56 as indicated by a line 42*b*. Furthermore, not limited to this example, the line 42 may be arranged in a region obtained by shifting part of the arrangement region of the line 41 in a direction so as not to overlap the region 56 and shifting the remaining part in a direction so as to overlap the region 56 (not illustrated).

Here, the region 56 interposed between the line 41 and the line 43 is a gap region located between the opposing sides 413 and 433 of the line 41 and the line 43. In FIG. 9, the region 56 is shaded gray and the lines 42*a* and 42*b* are respectively illustrated using the dashed lines and the dot and dash lines.

A configuration in which the line 42 is arranged in the same region as the line 41, i.e., a configuration in which the line 42 and the line 41 completely overlap in a plan view as is the case for the lines 41 and 42 illustrated using the solid lines in FIG. 9 is effective for stabilizing the degree of coupling between the main line and the sub line of the directional coupler 3.

In a configuration in which the line 42 is arranged so as to be shifted from the line 41 in a direction so as to not overlap the region 56 as indicated by the line 42*a* for example, the adjustment degree of coupling between the line 42 and the line 43 becomes smaller, and therefore the degree of coupling of the directional coupler 3 can be adjusted so as to realize looser coupling compared with a configuration in which the line 42 and the line 43 are arranged in the same region.

In a configuration in which the line 42 is arranged so as to be shifted from the line 41 in a direction so as to overlap the region 56 as indicated by the line 42*b* for example, the adjustment degree of coupling between the line 42 and the line 43 becomes larger, and therefore the degree of coupling of the directional coupler 3 can be adjusted so as to realize tighter coupling compared with the configuration in which the line 42 and the line 43 are arranged in the same region.

It is not necessary for the line 41 and the line 42 to be connected to each other at both ends in order to adjust the degree of coupling. The line 41 and the line 42 may be connected to each other at just one end.

Figure 10:
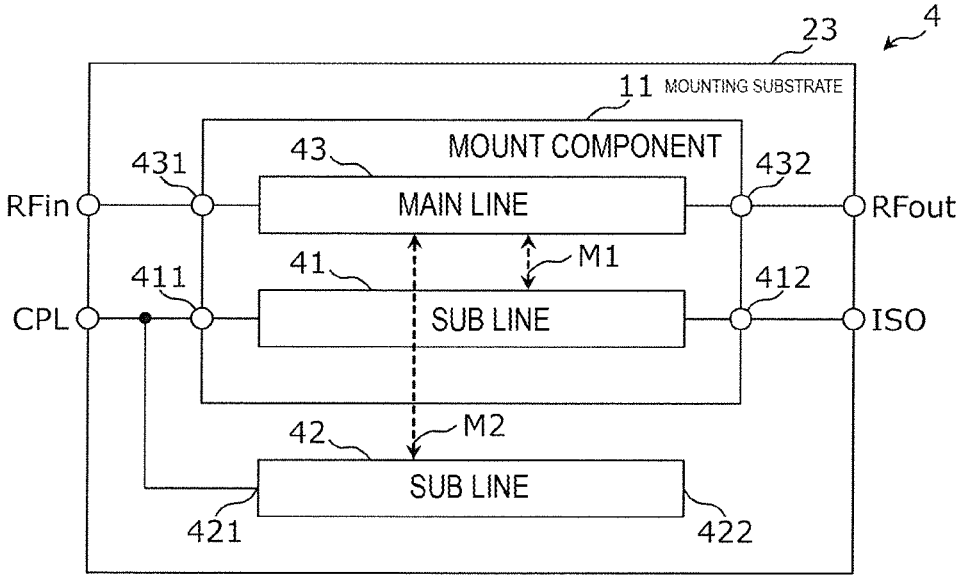
FIG. 10 is a circuit diagram illustrating an example of the functional configuration of a directional coupler according to a modification of embodiment 2.

FIG. 10 is a circuit diagram illustrating an example of the functional configuration of a directional coupler according to a modification. As illustrated in FIG. 10, compared with the directional coupler 3 in FIG. 7, in a directional coupler 4, the wiring conductor that connects the other end 412 of the line 41 and the other end 422 of the line 42 to each other is omitted from a mounting substrate 23. Therefore, in the directional coupler 4, the lines 41 and 42 are connected to each other only at the one ends 411 and 421.

In the directional coupler 4 as well, the line 41 and the line 42 are connected to each other at the one ends 411 and 421 and as a result, the overall degree of coupling of the directional coupler 4 can be adjusted using the degree of coupling M2 between the line 42 and the line 43.

Directional couplers according to embodiments of the present disclosure have been described above, but the present disclosure is not limited to these embodiments. Various modifications, as thought of by those skilled in the art, made to the embodiments and other embodiments formed by combining constituent elements of different embodiments may also be included in the scope of one or a plurality of modes of the present disclosure so long as the modifications and embodiments do not depart from the spirit of the present invention.

For example, a configuration for adjusting directivity may be added to the directional couplers 1 to 4 described in the embodiments.

In a directional coupler in which the sub line is formed inside the surface mounted component, the directivity can be adjusted by variable termination of the isolation port side of the sub line using a variable impedance circuit formed inside the same surface mounted component. In contrast, in a directional coupler in which the sub line is formed only on or in the mounting substrate, variable termination of the sub-line would not significantly contribute to the characteristics of the directional coupler and the directivity would not be able to be effectively adjusted.

With respect to this, for the directional couplers 1 to 4 in which at least part of the sub line is formed inside the mounted component, a variable terminator can be added and the directivity can be adjusted by terminating the end of the sub line on the isolation port side using the variable terminator.

Figure 11:
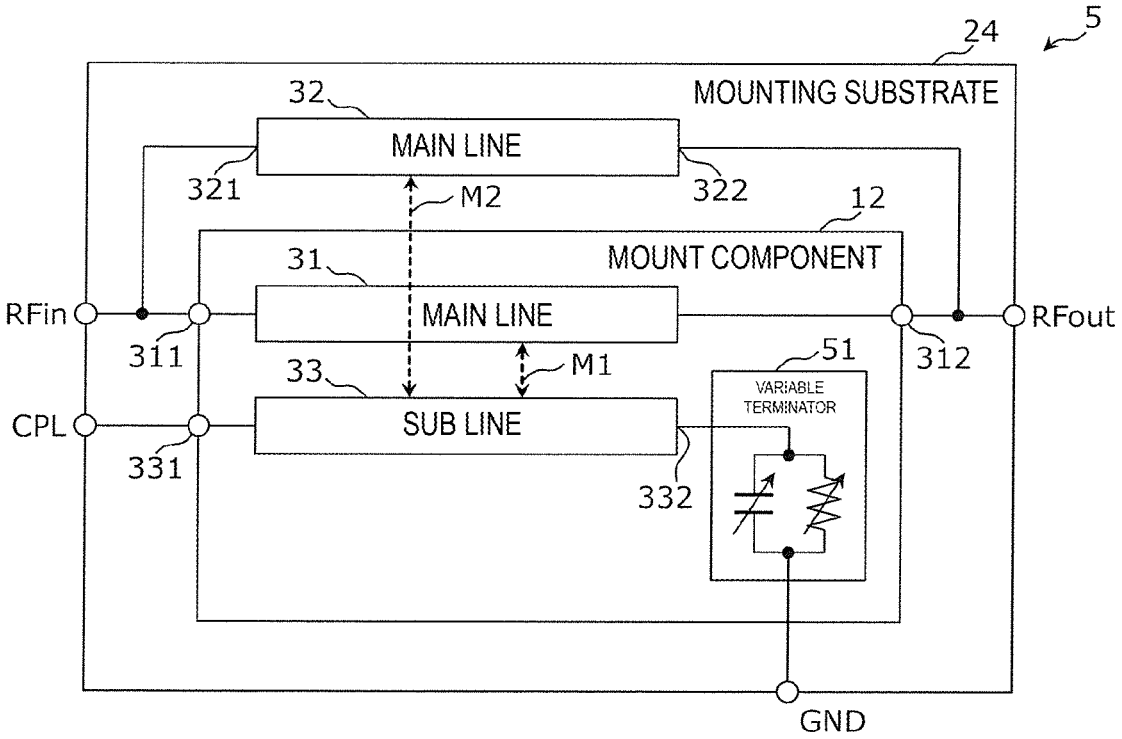
FIG. 11 is a circuit diagram illustrating an example of the functional configuration of a directional coupler according to another modification.

FIG. 11 is a circuit diagram illustrating an example of the functional configuration of a directional coupler according to another modification. A directional coupler 5 in FIG. 11 differs from the directional coupler 1 in FIG. 1 in that the end of the sub line on the isolation port ISO side is terminated with a variable terminator 51 and the isolation port ISO is omitted.

In the example in FIG. 11, the variable terminator 51 is formed of a variable capacitor and a variable resistor formed in a surface mounted component 12. A mounting substrate 24 is provided with a ground port GND and a ground voltage is supplied to the ground port GND. The other end 332 of the line 33, which is the sub line, is terminated by being connected to the ground port GND via the variable terminator 51.

According to the directional coupler 5, the impedance for terminating the other end 332 of the line 33 (i.e., the end of the sub line on the isolation port ISO side) can be varied and therefore the directivity can be adjusted in accordance with the change in the impedance. The variable terminator 51 is not limited to being added to the directional coupler 1 and may be added to any one of the directional couplers 2 to 4.

Thus, a directional coupler having adjustable directivity in addition to the effects described in the embodiments is obtained by adding a variable terminator, which is inside the surface mounted component, to the directional coupler described in the embodiments and variably terminating the sub line using the variable terminator.

SUMMARY OF EMBODIMENTS

A directional coupler according to one mode disclosed herein includes a surface mounted component and a mounting substrate on which the surface mounted component is mounted. Among a main line and a sub line of the directional coupler, one line is formed of a first line and a second line, one end of the first line and one end of the second line being connected to each other, the other line is formed of a third line, the first line and the third line are formed in the surface mounted component, and the second line is formed on or in the mounting substrate.

In this configuration, the degree of coupling of the directional coupler is determined by a degree of coupling generated in the surface mounted component between the first line and the third line and the degree of coupling between the surface mounted component and the mounting substrate, which is between the second line and the third line. Therefore, the degree of coupling generated in the surface mounted component can be regarded as the principle degree of coupling of the directional coupler and the degree of coupling of the directional coupler can be adjusted using the degree of coupling between the surface mounted component and the mounting substrate.

Furthermore, another end of the first line and another end of the second line may be connected to each other.

According to this configuration, the first line and the second line are connected to each other at both ends, and therefore the degree of coupling between the main line and the sub line can be stabilized.

The one line among the main line and the sub line may be the main line.

In general, the line formed on or in the mounting substrate will tend to have a larger film thickness and a larger wiring width than the line formed in the surface mounted component. In addition, signal loss becomes smaller as the film thickness and width of a line through which a signal flows increase. Therefore, the insertion loss of the main line can be reduced by forming the main line not only in the surface mounted component but also on or in the mounting substrate. In addition, since the impedance of the main line is reduced, it is easier to bring the impedance closer to a reference impedance for matching such as 50Ω and return loss is reduced.

In addition, in a plan view of the mounting substrate, a region may exist that is interposed between the first line and the third line and at least part of the second line and the region may not overlap.

With this configuration, the degree of coupling between the main line and the sub line can be adjusted to realize looser coupling.

In addition, in a plan view of the mounting substrate, the second line and the third line may be arranged in the same region.

With this configuration, the degree of coupling between the main line and the sub line can be stabilized.

In addition, in a plan view of the mounting substrate, a region may exist that is interposed between the first line and the third line and at least part of the second line and the region may overlap.

With this configuration, the degree of coupling between the main line and the sub line can be adjusted to realize tighter coupling.

Furthermore, the directional coupler may further include a variable terminator that is connected to the sub line.

According to this configuration, a directional coupler is obtained that has a variable directivity in addition to the above-described effects.

The present disclosure can be broadly used as a directional coupler.

1, 2, 3, 4, 5 directional coupler
10, 11, 12 surface mounted component
15, 16 conductive bonding material
20, 21, 22, 23, 24 mounting substrate
25, 26 via conductor
31, 32, 32*a*, 32*b*, 33, 41, 42, 42*a*, 42*b*, 43 line
51 variable terminator
55, 56 region
311, 321, 331, 411, 421, 431 one end (of line)
312, 322, 332, 412, 422, 432 other end (of line)
313, 333, 413, 433 opposing side (of line)
RFin input port
RFout output port
CPL coupling port
ISO isolation port.

The invention claimed is:

1. A directional coupler comprising:

a surface mounted component; a mounting substrate on which the surface mounted component is mounted; and a main line and a sub line each provided on or in either the surface mounted component or the mounting substrate;

wherein, among the main line and the sub line, one line is comprised of a first line and a second line, one end of the first line and one end of the second line being connected to each other, another line is comprised of a third line, wherein the first line and the third line are provided on or in the surface mounted component, wherein the second line is provided on or in the mounting substrate, and wherein the mounting substrate is separate from the surface mount component.

2. The directional coupler according to claim 1, wherein another end of the first line and another end of the second line are connected to each other.

3. The directional coupler according to claim 2, wherein in a plan view of the mounting substrate, the mounting substrate comprises a region interposed between the first line and the third line, and at least a part of the second line and the region do not overlap.

4. The directional coupler according to claim 2, wherein in a plan view of the mounting substrate, the mounting substrate comprises a region interposed between the first line and the third line, and at least a part of the second line and the region overlap.

5. The directional coupler according to claim 2, further comprising:

a variable terminator connected to the sub line.

6. The directional coupler according to claim 2, wherein the one line among the main line and the sub line is the main line.

7. The directional coupler according to claim 6, wherein in a plan view of the mounting substrate, the mounting substrate comprises a region interposed between the first line and the third line, and at least a part of the second line and the region do not overlap.

8. The directional coupler according to claim 6, wherein in a plan view of the mounting substrate, the mounting substrate comprises a region interposed between the first line and the third line, and at least a part of the second line and the region overlap.

9. The directional coupler according to claim 6, further comprising:

a variable terminator connected to the sub line.

10. The directional coupler according to claim 1, wherein in a plan view of the mounting substrate, the mounting substrate comprises a region interposed between the first line and the third line, and at least a part of the second line and the region do not overlap.

11. The directional coupler according to claim 10, further comprising:

a variable terminator connected to the sub line.

12. The directional coupler according to claim 10, wherein in a plan view of the mounting substrate, the second line and the third line are arranged in a same region.

13. The directional coupler according to claim 12, further comprising:

a variable terminator connected to the sub line.

14. The directional coupler according to claim 1, further comprising:

a variable terminator connected to the sub line.

15. A directional coupler comprising:

a surface mounted component a mounting substrate on which the surface mounted component is mounted; and a main line and a sub line each provided on or in either the surface mounted component or the mounting substrate;

wherein, among the main line and the sub line, one line is comprised of a first line and a second line, one end of the first line and one end of the second line being connected to each other, another line is comprised of a third line, the first line and the third line are provided on or in the surface mounted component, and the second line is provided on or in the mounting substrate, wherein in a plan view of the mounting substrate, the mounting substrate comprises a region interposed between the first line and the third line, and at least a part of the second line and the region overlap.

16. The directional coupler according to claim 15, further comprising:

a variable terminator connected to the sub line.

* * * * *